US006823568B1

(12) United States Patent
Kobayashi et al.

(10) Patent No.: US 6,823,568 B1
(45) Date of Patent: Nov. 30, 2004

(54) NONWOVEN FABRIC AND METHOD FOR MAKING SAME

(75) Inventors: Toshio Kobayashi, Kagawa-ken (JP); Miou Suzuki, Kagawa-ken (JP); Naohito Takeuchi, Kagawa-ken (JP)

(73) Assignee: Uni-Charm Corporation, Ehime-ken (JP)

( * ) Notice: Subject to any disclaimer, the term of this patent is extended or adjusted under 35 U.S.C. 154(b) by 0 days.

(21) Appl. No.: 09/652,396

(22) Filed: Aug. 31, 2000

Related U.S. Application Data

(62) Division of application No. 09/220,223, filed on Dec. 23, 1998.

(30) Foreign Application Priority Data

Dec. 26, 1997 (JP) ..... 9-359099

(51) Int. Cl.[7] ..... D04H 1/46

(52) U.S. Cl. ..... 28/104; 28/105; 442/408; 428/156; 428/174; 428/175

(58) Field of Search ..... 28/104, 105; 442/408; 428/156, 174, 175

(56) References Cited

U.S. PATENT DOCUMENTS 4,100,324 A 7/1978 Anderson et al.
4,665,597 A 5/1987 Suzuki et al.
5,281,461 A * 1/1994 Greenway et al. ..... 428/105
5,573,841 A * 11/1996 Adam et al. ..... 428/219
5,914,084 A * 6/1999 Benson et al. ..... 264/284

FOREIGN PATENT DOCUMENTS

| | | | |
|---|---|---|---|
| EP | 0 215 684 A | | 3/1987 |
| EP | 373974 | * | 6/1990 |
| EP | 0 560 556 A | | 9/1993 |
| JP | 55 068367 A | | 5/1980 |
| JP | 61-176346 | | 8/1986 |
| JP | 62-69867 | | 3/1987 |
| JP | 5 277053 A | | 10/1993 |
| JP | 9 324354 A | | 12/1997 |
| WO | WO 96 12849 A | | 5/1996 |

* cited by examiner

*Primary Examiner*—Elizabeth M. Cole
(74) *Attorney, Agent, or Firm*—Butzel Long

(57) ABSTRACT

A nonwoven fabric suitable to be used as a kitchen paper including thermoplastic synthetic fibers being 7~30 mm long and as fine as of 0.1~0.8 d, in 90~10% by weight and pulp fibers being 2~7 mm long, in 10~90% by weight, these component fibers being mixed together as homogeneously as possible and mechanically entangled so as to have a basis weight of 10~80 g/m$^2$ as a whole.

6 Claims, 3 Drawing Sheets

NONWOVEN FABRIC AND METHOD FOR MAKING SAME

This is a division of application Ser. No. 09/220,223, filed Dec. 23, 1998.

BACKGROUND OF THE INVENTION

This invention relates to nonwoven fabrics well adapted to embossing and suitable for use as water-absorbent kitchen papers, wipe-out sheets, etc. as well as a method for making such nonwoven fabric.

It is well known to emboss/deboss nonwoven fabrics comprising a mixture of thermoplastic synthetic fibers having a fineness of 1~10 d and thereby to form an emboss/a deboss pattern thereon so that the nonwoven fabric may be used as water-absorbent kitchen papers or wipe up sheets.

However, it is not necessarily easy to form irregularities thereon by embossing the kitchen papers or the like of the prior art because the synthetic fiber has relatively high rigidity and elasticity. This is true particularly when it is desired to form fine or distinctly contoured embosses/debosses.

When it is attempted to feed a web of nonwoven fabric through an embossing machine and thereby to obtain kitchen papers formed with apertures each having a diameter in order of 5 mm or less, individual fibers may often extend from the aperture periphery into this aperture, resulting in the indistinctly contoured aperture. Probably, it is for the reason that the individual fibers can not be smoothly rearranged around each of projections provided on the embossing machine sufficiently to form the desired distinctly contoured aperture. The smaller a diameter of the aperture and/or the larger a basis weight of a nonwoven fabric is, the greater this problem becomes. While it is obvious that the individual fibers extending into the aperture lead to a substantial reduction of the aperture's diameter, a degree of such reduction is not necessarily uniform. This makes a proper design of the aperture difficult. Accordingly, it is required for nonwoven fabric used as material for kitchen papers or the like to have a sufficiently high formability to facilitate formation of embosses/debosses or apertures.

SUMMARY OF THE INVENTION

In view of the problem as has been described above, it is an object of the invention to provide a nonwoven fabric having a sufficiently high formability to facilitate formation of embosses/debosses or apertures when such nonwoven fabric is intended to be used as material for kitchen papers or the like, on one hand, and to provide a method for making such nonwoven fabric.

According to a first aspect of the invention, there is provided a nonwoven fabric containing thermoplastic synthetic microfibers, the nonwoven fabric comprising synthetic microfibers being 5~30 mm long and as fine as of 0.1~0.8 d, in 90~10% by weight, mixed and mechanically entangled with pulp fibers being 2~7 mm long, in 10–90% by weight, so as to have a basis weight of 10~80 g/m$^2$ as a whole.

According to the first aspect of the invention, melt blown fibers are preferably selected as the thermoplastic synthetic fibers.

According to a second aspect of the invention, there is provided a method for making a nonwoven fabric containing thermoplastic synthetic microfibers, the method comprising the steps of:

a. obtaining a wet sheet from slurry containing 0.5~20% by weight of a fibrous mixture dispersed in water, the fibrous mixture comprising thermoplastic synthetic fibers being 7–30 mm long and as fine as of 0.1~0.8 d, in 90~10% by weight, mixed with pulp fibers being 2~7 mm long, in 10~90% by weight; and b. placing the wet sheet on a support and then subjecting the wet sheet to high velocity water jet streams of 50–200 kgf/cm$^2$ for mechanically entangling the fibrous mixture.

According to the second aspect of the invention, melt blown fibers are preferably selected as the thermoplastic synthetic fibers.

DESCRIPTION OF THE PREFERRED EMBODIMENT

Details of a nonwoven fabric and a method for making the nonwoven fabric will be more fully understood from the description given hereunder with reference to the accompanying drawings.

Figure 1:
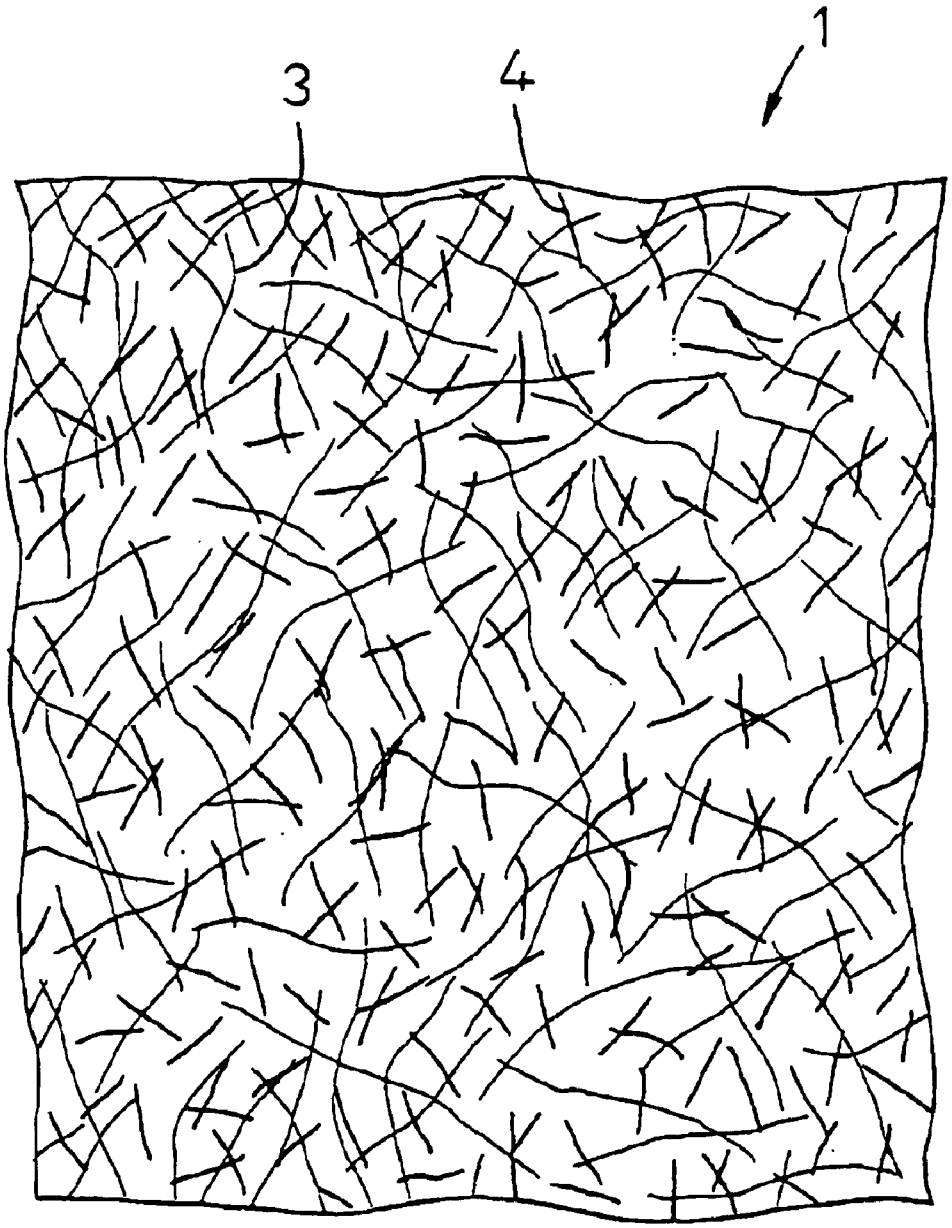
FIG. 1 is a plan view of a nonwoven fabric according to the invention.

FIG. 1 is a plan view of a nonwoven fabric. The nonwoven fabric 1 has a basis weight of 10~80 g/m$^2$ and the nonwoven fabric 1 comprises thermoplastic synthetic fibers 3 being 7~30 mm long and as fine as of 0.1~0.8 d, in 90~10% by weight, and pulp fibers 4 (e.g., NBKP), in 10~90% by weight. These fibers 3, 4 are mixed with each other as homogeneously as possible so that they are mechanically entangled to maintain the form of a nonwoven fabric. Individual fibers are randomly distributed or slightly oriented in the machine direction during a manufacturing process of the nonwoven fabric 1 as will be described later. It should be understood that none of binding agents such as poval is employed in making the nonwoven fabric.

Figure 2:
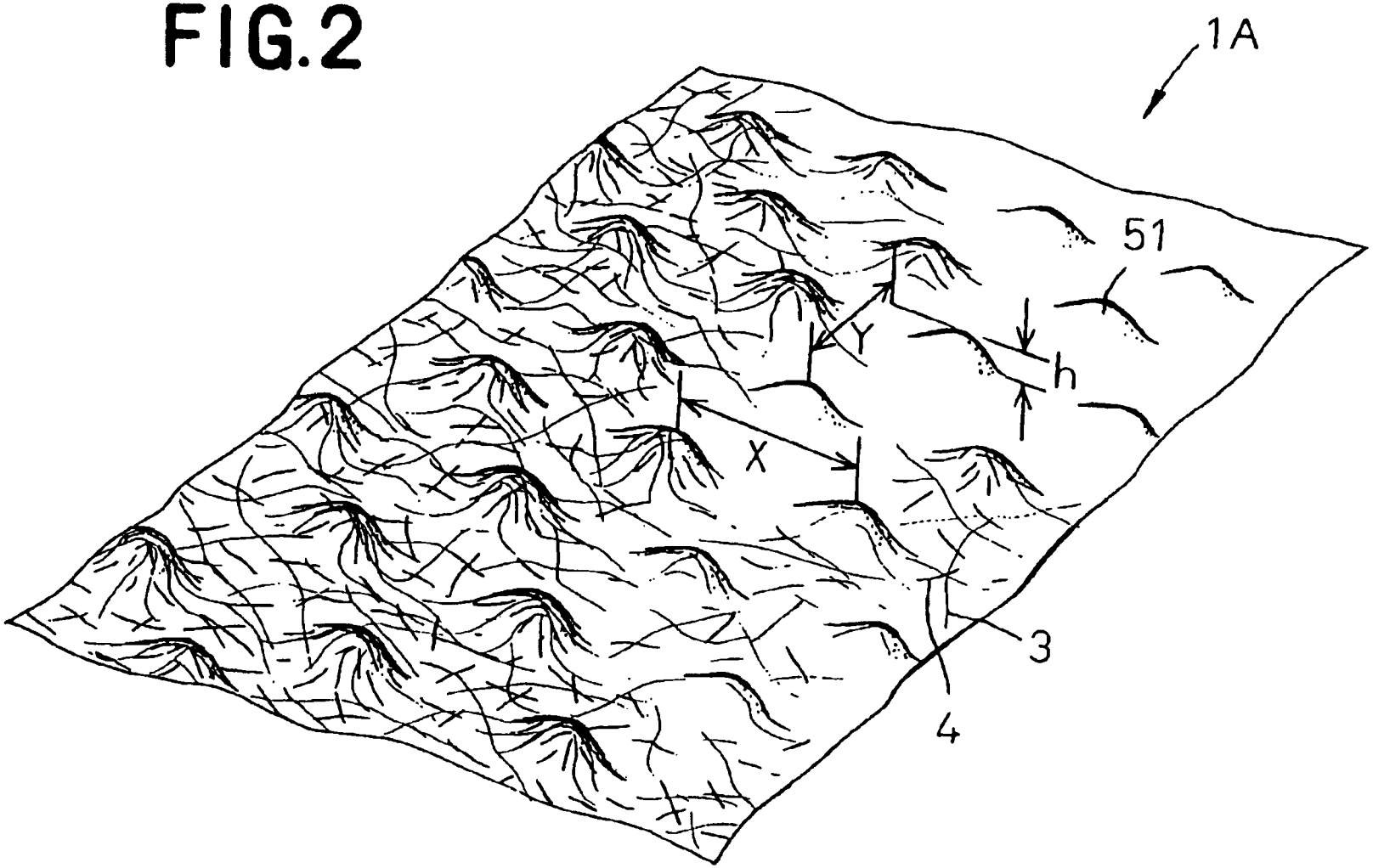
FIG. 2 is a perspective view of a kitchen paper made of the nonwoven fabric according to the invention.

FIG. 2 is a perspective view of a nonwoven fabric 1A having a plurality of protuberances 51 obtained by embossing or depossing the nonwoven fabric of FIG. 1, which is adapted to be used as a kitchen paper. As seen in FIG. 2, the nonwoven fabric 1A is formed with the protuberances 51 having a height h and arranged at a pitch y in the longitudinal direction and at a pitch x in the transverse direction. The height h is in a range of 0.2~5 mm and the pitches y, x are in a range of 1~10 mm. While the synthetic fibers 3 and the pulp fibers 4 are observed to be slightly oriented so far as regions defined from bases toward crests of the respective protuberances 51 are concerned, they are randomly distributed in regions defined between each pair of the adjacent protuberances 51 just as in the nonwoven fabric of FIG. 1.

Figure 3:
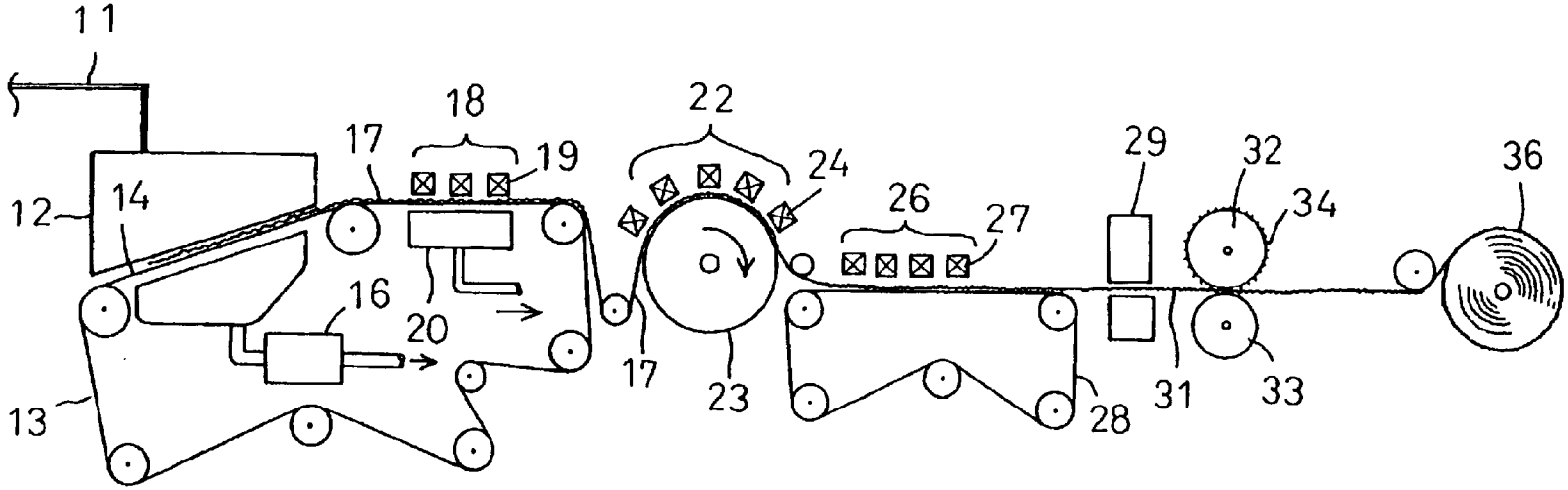
FIG. 3 is a diagram schematically illustrating the steps of a method for making the nonwoven fabric.

FIG. 3 is a diagram exemplarily illustrating the steps of the inventive method for making the nonwoven fabric 1 and the kitchen paper 1A obtained therefrom. The method starts from the left in FIG. 3. Slurry containing 0.5~20% by weight of the fibrous mixture which comprises, in turn, the thermoplastic synthetic fibers 3 and the pulp fibers 4 at a weight ratio of 10:90~90:10 is supplied through a feed pipe 11 to a slurry tank 12. From the slurry tank 12, slurry is then fed onto a first endless belt 13 in a suction zone 14 in which the first endless belt 13 describes a rightward ascending slope.

In the suction zone 14, the slurry is dehydrated by a vacuum pump 16 and thereby a wet sheet 17 is obtained. The wet sheet 17 is then subjected, in a first zone 18, to high velocity water jet streams injected from a first nozzle 19 to stabilize a texture of the wet sheet 17 which is then transferred to a rotary drum 23 installed in a second zone 22. The amount of water injected in the first zone 18 is drawn by a suction mechanism 20. In the second zone 22, the wet sheet 17 supported on a smooth surface of the rotary drum 23 is subjected to high velocity water jet streams injected from a second nozzle 24 to ensure that component fibers of the wet sheet 17 are mechanically entangled together. Now the wet sheet 17 is transferred to a second endless belt 28 and subjected, in a third zone 26, to high velocity water jet streams injected from a third nozzle 27. Thereafter, the wet sheet 17 is dehydrated and dried by dehydrator/drier means 29 to obtain a nonwoven fabric 31. As will be apparent, the nonwoven fabric 31 may be cut into an appropriate size to obtain the nonwoven fabric 1 of FIG. 1. If desired, the nonwoven fabric 31 may be further transported so as to pass between a pair of embossing rolls 32, 33. The embossing roll 32, one of these rolls, is formed on its peripheral surface with forming elements 34 comprising a plurality of conical or pyramidal projections so that a continuous sheet of kitchen paper 1A having the protuberances 51 as shown in FIG. 2 is obtained as the forming elements 34 are pressed against the nonwoven fabric 31. The continuous sheet of nonwoven fabric 31 or kitchen paper 1A obtained in this manner may be taken up in the form of a roll 36. If necessary, such continuous sheet of nonwoven fabric 31 or kitchen paper 1A may be further processed, using an embossing machine or the like, to be formed with a plurality of apertures each having a diameter of 0.5~5 mm.

Along the line of production as has been described above, it is preferably that the second and third zones 22, 26 are also provided with the suction mechanisms 20 similar to those provided in the first zone 18. The high velocity water jet streams injected in the first, second and third zones 18, 22, 26 is preferably columnar streams and pressure of these water jet streams is preferably adjusted within a range of 50~200 kgf/cm$^2$. It is not always necessary to use all of the first, second and third zones but any one or more of these zones may be eliminated from the line of production.

Figure 4:
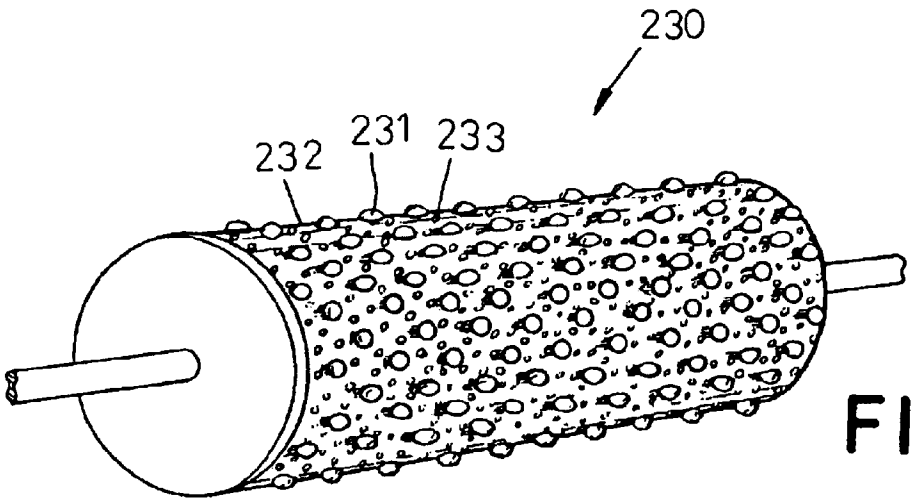
FIG. 4 is a perspective view of a drum used in the method.

FIG. 4 is a perspective view of a drum 230 provided on its peripheral surface with a flat zone 232, a plurality of projections 231 and a plurality of drain holes 233. The drum 23 having the smooth peripheral surface used in the line of production as illustrated by FIG. 3 may be replaced by the drum 230 to obtain the continuous sheet of kitchen paper 1A similar to that shown in FIG. 2. The drum 230 is disclosed in Japanese Patent Application Disclosure Gazettes Nos. Sho61-176346 and Sho62-69867. When the high velocity water jet streams impinge against the wet sheet 17 placed on the drum 230, the component fibers 3, 4 are reoriented so as to follow the configurations of the projections 231 and consequently the sheet 17 is formed with the protuberances 51. The protuberances 231 are distributed on the drum 230 in conformity with the distribution pattern of the forming elements 34 in FIG. 3. Accordingly, the step of forming the protuberances by the pair of rolls 32, 33 in FIG. 3 can be eliminated so far as the drum 230 is employed. The drum 230 may be in the form of a drum having its peripheral surface formed by a mesh screen when knuckles of the mesh screen are used as protuberance forming elements.

The nonwoven fabric 31 obtained by the method illustrated in FIG. 3 can reproduce the configurations of the forming elements 34 with a relatively high precision because both component fibers 3, 4 are relatively short, on one hand, and the synthetic fibers 3 has a relatively low fineness as well as a relatively low rigidity. When the forming elements 34 have a height h as small as 1~3 mm and/or the forming elements 34 are polygons having sharp ridgelines, an excellent formability of the nonwoven fabric 31 can be particularly effective. Such nonwoven fabric 31 preferably has a basis weight of 10~80 g/m$^2$ and the synthetic fibers 3 preferably comprises melt blown fibers.

In the line of production illustrated in FIG. 3, the slurry containing relatively short fibers 3, 4 is fed onto the endless belt 13 describing an ascending slope and thereby orientation of these fibers 3, 4 in the direction in which the belt 13 travels, i.e., in the machine direction is effectively prevented. As a result, the fibers 3, 4 are slightly oriented in the machine direction or randomly distributed between each pair of the adjacent protuberances 51 on the kitchen paper 1A. In this manner, the kitchen paper 1A is relatively isotropic.

It is possible to form a nonwoven fabric having protuberances by subjecting a web fed from a card of prior art to the processing steps illustrated in FIG. 3 starting from the first zone 18. However, the fibers which can be effectively processed by the conventional card is limited to that approximately 30 mm or longer and therefore it is difficult for the prior art to make the nonwoven fabric 1 or 31 presenting a high formability as realized by the invention.

The nonwoven fabric according to the invention comprises the pulp fibers of a relatively short fiber length mechanically entangled with the thermoplastic synthetic fibers also of a relatively short fibers length and a low fineness. Such unique composition enables the nonwoven fabric to precisely reproduce the configurations of the forming elements and thereby to have an excellent formability. It is possible to provide such nonwoven fabric with a desired water absorbability by properly selecting a mixture ratio of the synthetic fibers and the pulp fibers. This nonwoven fabric can be made useful particularly as kitchen papers or wipe up sheets after its surface has been formed with a plurality of protuberances or apertures.

By utilizing the inventive method for making the nonwoven fabric, it is possible to obtain even from fibrous material having a fiber length too short to be processed by the conventional card.

What is claimed is:

1. A method of making a nonwoven fabric containing thermoplastic synthetic microfibers, said method comprising the steps of:

a. providing a wet sheet from a slurry containing about 0.5 to 20% by weight of a fibrous mixture dispersed in water, said fibrous mixture comprising about 90 to 10% by weight of thermoplastic fibers that are about 7 to 30 mm long and as fine as about 0.1 to 0.8 d mixed with about 10 to 90% by weight of pulp fibers that are about 2 to 7 mm long;

b. placing said wet sheet on a support;

c. subjecting said wet sheet to high velocity water jet streams of about 50 to 200 kgf/cm$^2$ to effect mechanically entangling of said fibrous mixture and to obtain a nonwoven fabric; and d. passing said nonwoven fabric between a pair of embossing rolls to produce a plurality of discrete protuberances in said nonwoven fabric, said plurality of discrete protuberances being spaced apart from one another in both a longitudinal and a transverse direction of the nonwoven fabric.

2. A method according to claim 1, wherein said thermoplastic synthetic fiber comprises melt blown fibers.

3. A method according to claim 1 wherein said support has a plurality of protuberances formed on a surface thereof and the mechanical entanglement if the fibrous mixture and formation of the protuberances are performed in a common step.

4. A method according to claim 1, wherein only one of the pair of embossing rolls is formed on a peripheral surface thereof with a plurality of projections having conical or pyramidal shapes.

5. A method according to claim 1, further comprising forming the nonwoven sheet with a plurality of apertures.

6. A method according to claim 1, wherein the plurality of protuberances formed in the nonwoven fabric comprise discrete protuberances that are arranged in a two dimensional pattern across the nonwoven fabric.

* * * * *